US007066571B2

(12) United States Patent
Eguchi et al.

(10) Patent No.: US 7,066,571 B2
(45) Date of Patent: Jun. 27, 2006

(54) LIQUID EJECTION APPARATUS

(75) Inventors: Takeo Eguchi, Kanagawa (JP); Takaaki Miyamoto, Kanagawa (JP); Minoru Kohno, Tokyo (JP); Kazuyasu Takenaka, Kanagawa (JP); Tatsumi Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 252 days.

(21) Appl. No.: 10/396,991

(22) Filed: Mar. 24, 2003

(65) Prior Publication Data

US 2004/0012649 A1 Jan. 22, 2004

(30) Foreign Application Priority Data

Mar. 26, 2002 (JP) ..... P2002-085023

(51) Int. Cl.
*B41J 2/15* (2006.01)
*B41J 2/145* (2006.01)

(52) U.S. Cl. ..... 347/40

(58) Field of Classification Search ..... 347/40, 347/42–43, 49, 61, 56

See application file for complete search history.

(56) References Cited

U.S. PATENT DOCUMENTS

| | | | | |
|---|---|---|---|---|
| 5,469,199 | A * | 11/1995 | Allen et al. | 347/42 |
| 5,867,192 | A | 2/1999 | Mantell et al. | |
| 6,375,309 | B1 * | 4/2002 | Taneya et al. | 347/48 |
| 6,382,768 | B1 * | 5/2002 | Koitabashi et al. | 347/48 |
| 6,412,903 | B1 | 7/2002 | Lee et al. | |
| 6,749,286 | B1 | 6/2004 | Eguchi | |
| 2002/0145640 | A1 | 10/2002 | Anderson et al. | |

FOREIGN PATENT DOCUMENTS

| | | |
|---|---|---|
| EP | 1 176 019 A2 | 1/2002 |
| EP | 1 238 805 A1 | 9/2002 |

* cited by examiner

*Primary Examiner*—Thinh Nguyen
(74) *Attorney, Agent, or Firm*—Robert J. Depke; Trexler, Bushnell, Blackstone, Giangiorgi & Marr

(57) ABSTRACT

In a liquid ejection apparatus including a plurality of chips arranged in a specific direction, each chip including a plurality of liquid ejection units juxtaposed in the specific direction, the displacement of liquid landing position in the specific direction is reduced. A printer head chip includes a heating resistor, which is divided into two and arranged within one ink liquid chamber. The two-divided heating resistors within the one ink liquid chamber are juxtaposed in a direction perpendicular to the lining-up direction of nozzles.

20 Claims, 16 Drawing Sheets

LIQUID EJECTION APPARATUS

This application claims priority to Japanese Patent Application Number JP2002-085023 filed Mar. 26, 2002 which is incorporated herein by reference.

BACKGROUND OF THE INVENTION

1. Field of the Invention

The present invention relates to a technique that in a liquid ejection apparatus having a plurality of chips arranged in a specific direction, each chip having a plurality of liquid ejection units juxtaposed in the specific direction, the displacement of a liquid ejection direction between the chips is reduced.

2. Description of the Related Art

Inkjet printers have been known as an example of a liquid ejection apparatus having a plurality of chips juxtaposed in a specific direction. As ink ejecting systems of the inkjet printer, there are a thermal system for ejecting ink using thermal energy and a piezoelectric system for ejecting ink using a piezoelectric element.

Also, from a viewpoint of an ink color, there are a single color type using one printer-head chip and a color type using a plurality of printer-head chips while ink with different color is ejected from each chip.

Furthermore, from a viewpoint of a head structure, there are a serial system using one printer-head chip for each color, which is moved in the width direction of printing paper for printing images thereon, and a line system having a number of printer-head chips juxtaposed in the width direction of printing paper for each color so as to form a line head for a width of the printing paper.

FIG. 12 is a plan view of a line head 10. In FIG. 12, four printer-head chips 1 ("N−1", "N", "N+1", and "N+2") are shown; however, further more numerous printer-head chips 1 are arranged in practice.

Each printer-head chip 1 has a plurality of nozzles la formed therein, each having an ejection hole for ejecting ink. The nozzles la are juxtaposed in a specific direction, which agrees with the width direction of printing paper. Furthermore, a plurality of the printer-head chips 1 are arranged in the above-mentioned specific direction. Adjacent printer-head chips 1 are arranged so that the respective nozzles la face each other while pitches of the nozzles la between adjacent printer-head chips 1 are in consecutive order (see a portion A in detail).

Moreover, an example of a structure of the above-mentioned thermal system printer-head chip has been known, which has an ink liquid chamber and a heating resistor arranged in the ink liquid chamber so as to pressurize (heat) ink ejecting within the ink liquid chamber. The nozzle is formed on the upper surface of the ink liquid chamber and constituted such that the ink pressurized within the ink liquid chamber is ejected from the ejection hole of the nozzle.

In addition to the example having a single heating resistor within the ink liquid chamber, another one having a plurality of heating resistors divided within one ink liquid chamber has been known.

FIG. 13 is a plan view of an example having two-divided heating resistors within one ink liquid chamber. The region of the ink liquid chamber 2 is substantially circular, and a flow path 2*a* communicated with an ink liquid chamber 2 is formed in the lower part of the drawing. Furthermore, two heating resistors 3 are arranged within the ink liquid chamber 2 in the lining-up direction of nozzles (in the right and left viewing the drawing).

As such an example, in a divided type in which the heating resistor 3 is halved longitudinally, since the width is halved while the length is the same, the resistance of the heating resistor 3 is doubled. If the two-divided heating resistors 3 are connected in series, the resistance quadruples.

The reason of such a structure is as follows.

In order to film-boil ink (a phenomenon of an entire surface boiling membranously) in the ink liquid chamber 2; it is necessary to heat the heating resistor 3 by supplying a predetermined amount of electric power to the heating resistor 3. By means of energy during the film boiling, the ink is ejected. If the resistance is small, it is necessary to increase the electric current to be passed, so that by increasing the resistance of the heating resistor 3, the film boiling can be performed with the small current.

Thereby, a transistor for passing electric current can be reduced in size, enabling a space to be reduced. In addition, the reduction in thickness of the heating resistor 3 increases the resistance; however, in view of the material and the strength (durability) selected as for the heating resistor 3, there is a predetermined limit in the reduction of thickness. Therefore, the resistance has been increased by dividing the heating resistor 3.

However, there have been the following problems in the conventional technique described above.

(First Problem)

First, during the ejecting ink from the printer-head chip, it is ideal that the ink be ejected perpendicularly to the ejection surface of the printer-head chip; however, there are cases where the ejecting angle of ink is not perpendicular depending on various factors.

For example, in the thermal printer-head chip, during the bonding a nozzle sheet having nozzles formed thereon, on the upper surface of the ink liquid chamber having the heating resistors 3, the displacement in the bonding position between the ink liquid chamber/the heating resistors 3 and the nozzles arises a problem. If the nozzle sheet is bonded so that the center of the nozzle is located at the center of the ink liquid chamber/the heating resistors 3, ink is ejected perpendicularly to the ink ejection surface (the nozzle sheet surface); however, if the center positions of the ink liquid chamber/the heating resistors 3 and the nozzles are displaced, the ink is not ejected perpendicularly to the ejection surface.

Also, the displacement due to the difference in the thermal expansion coefficient between the ink liquid chamber/the heating resistors and the nozzle sheet may be produced.

When ink is ejected perpendicularly to the ejection surface, an ink drop is landed at a precise position. If the ejecting ink is displaced by an angle of θ from perpendicularity, the displacement of the landing position of the ink drop ΔL is expressed by:

$$\Delta L = G \times \tan\theta,$$

wherein the distance between the ejection surface and the printing paper surface (the landing surface of the ink drop) is G (generally 1 to 2 mm for the inkjet system).

When such displacement in the ink ejection angle is generated, the image quality is not noticed so much in the serial system, whereas in the line system, it becomes a problem. This will be described as follows.

FIG. 14 includes a sectional view and a plan view showing an image-printing state using a head 1A having one printer-head chip in the serial system. In the sectional view of FIG. 14, if printing paper P is considered as being fixed, the head 1A moves so as to print images on the printing paper P in the conveying direction of the printing paper P in the drawing while reciprocating in the width directions of the printing paper P. The sectional view of FIG. 14 shows passing positions of the head 1A for the N-th and the (N+1)-th time.

Also, as shown by an arrow in the sectional view, FIG. 14 shows an example of the ink ejected at a slant in the left in the drawing, i.e., in the conveying direction of the printing paper P. At this time, the ink landing position is displaced in the left in the drawing; however, even if the ink is ejected at a slant at the N-th moving of the head 1, for example, the ink is ejected at the same angle also at the (N+1)-th moving. Therefore, the connection portion between the landing position of the head 1A in the movement for the N-th time and the landing position of the head 1A in the movement for the (N+1)-th time is not noticeable. That is, the reason is that the image printing is performed by the same head 1A having the same ejection characteristics both at the N-th and the (N+1)-th moving.

Also, in the case where ink is ejected at a slant in the moving direction of the head 1A, although the ink is landed out of alignment with the reference position at both ends in the width direction of the printing paper P, the ink landing position at the ends in the width direction of the printing paper P is not changed between passing positions of the head 1A for the N-th and the (N+1)-th time. Therefore, also in this case, the displacement of the ink landing position is not noticeable.

In the case where a plurality of color printer-head chips are provided, ink ejection characteristics may be different for each printer-head chip, and color misalignment is produced in this case. However, since the resolution of the color misalignment in human eyes is not so large, the misalignment of a single color is scarcely recognizable even in the case of documents where the color misalignment is mostly recognizable.

For color images such as a photograph, a technique may be frequently used, in which ink is landed in plural times with different nozzles in one printer-head chip for the same color so as to defuse the displacement within the printer-head chip, so that the color misalignment is scarcely recognizable.

FIG. 15 includes a sectional view and a plan view showing an image-printing state in the line head 10 shown in FIG. 12 (line head having a plurality of printer-head chips 1 arranged in the lining-up direction of the nozzles 1*a*). Referring to FIG. 15, if printing paper P is considered as being fixed, the line head 10 does not move in the width direction of the printing paper P but moves from the upper to the lower direction in the plan view so as to print images.

In the sectional view of FIG. 15, three N-th, (N+1)-th, and (N+2)-th printer-head chips 1 of the line head 10 are shown.

The sectional view shows examples that in the N-th printer-head chip 1, ink is ejected at a slant in the left of the drawing as shown by an arrow; in the (N+1)-th printer-head chip 1, ink is ejected at a slant in the right of the drawing as shown by an arrow; and in the (N+2)-th printer-head chip 1, ink is ejected vertically without slanting as shown by an arrow.

Accordingly, in the N-th printer-head chip 1, ink is landed away from the reference position in the left; and in the (N+1)-th printer-head chip 1, ink is landed away from the reference position in the right. Therefore, between both the printer-head chips 1, ink is landed in the direction moving away from each other. As a result, between the N-th printer-head chip 1 and the (N+1)-th printer-head chip 1, a region is formed where ink is not ejected. The line head 10 does not move in the width direction of the printing paper P but only moves in an arrow direction in the plan view. Thereby, between the N-th printer-head chip 1 and the (N+1)-th printer-head chip 1, a white stripe B is produced, reducing printed image quality.

Also, in the same way as mentioned above, since in the (N+1)-th printer-head chip 1, ink is landed at a slant away from the reference position in the right, between the (N+1)-th printer-head chip 1 and the (N+2)-th printer-head chip 1, a region is formed where landing positions of the ink are overlapped with each other. Thereby, there has been a problem in that images are discontinuous or stripes C are produced so as to reduce printing image quality.

Other than the case where the ink landing position of each printer-head chip 1 is displaced in the lining up direction of the nozzles as described above, it may be displaced in the moving direction of the printing paper P in some cases. FIG. 16, in the same manner as in FIG. 15, includes a sectional view and a plan view showing a printing state in the line head 10.

FIG. 16 shows an example in that the ink landing positions of the N-th printer-head chip 1 and the (N+2)-th printer-head chip 1 are not displaced in the moving direction of the printing paper P while the ink landing position of the (N+1)-th printer-head chip 1 is displaced in the moving direction of the printing paper P upward on the plan view.

In such a manner, in the case where the ink landing position is displaced in the moving direction of the printing paper P between the printer-head chips 1, the displacement appears stepwise as shown on the plan view. However, this landing position displacement appears as a step only at a printing start position or completion position, and it is not so conspicuous as the above-mentioned displacement in the lining-up direction of nozzles. Therefore, this displacement scarcely affects the image printing quality.

In addition, in the case where the ink landing position is displaced as described above, the conspicuousness of the stripe depends on the kind of images to be printed. For example, in documents, since white spaces are great, even when a stripe is produced, it is inconspicuous. Whereas when photographic images are printed with full color on the substantially entire region of the printing paper P, even a small white stripe may be conspicuous.

In the above-description, the ink landing displacements in the lining-up direction of nozzles and in the moving direction of the printing paper P are illustrated; in practice, pitch errors between the juxtaposed printer-head chips and displacements in the rotational direction may also be produced.

(Second Problem)

In a printer-head chip 1 with each ink liquid chamber having one heating resistor, ink priming (film boiling) by the heating resistor is performed only at one time. However, as shown in FIG. 13, in the case where each ink liquid chamber 2 has the heating resistor 3 divided into two, a difference is produced in the time until arriving at the temperature at which each heating resistor 3 film-boils ink (time until bubbles are produced), so that there may be a problem that the two heating resistors 3 may not film-boil the ink simultaneously.

In such a manner, if there is a difference in the time until arriving at the temperature at which two heating resistors 3 film-boil ink, the ink ejection angle deviates from the vertical direction, so that there is a problem of reduction in printing image quality due to the displacement in the ink landing position, as described above.

FIG. 17 includes graphs showing a relationship between a time difference until ink bubbles are produced by each heating resistor and the ink ejection angle, when divided heating resistors shown in FIG. 13 are provided. The values in these graphs are obtained by computer simulation. In these graphs, the X-direction (remark: not referred to the abscissa of the graph) is a lining-up direction of nozzles (the juxtaposing direction of the heating resistors), while the Y-direction (remark: not referred to the ordinate of the graph) is a direction perpendicular to the X-direction (the conveying direction of the printing paper).

In addition, the difference in time until bubbles are produced is plotted in the abscissa as data in these graphs; in examples shown in FIG. 17, a time difference of 0.04 μsec is equivalent to a resistance difference of 3%, and a time difference of about 0.08 μsec is equivalent to a resistance difference of about 6%.

As is understood from these graphs, the displacement of the ink ejection angle in the X-direction increases as the difference in time until bubbles are produced increases, while the displacement of the ink ejection angle in the Y-direction is scarcely affected by the difference in time until bubbles are produced.

FIGS. 18 and 19 are graphs showing actual measurements obtained from an actually manufactured printer-head chip with each ink liquid chamber having the heating resistor divided into two, as shown in FIG. 13. This printer-head chip has 336 nozzles, and the displacements of the ink landing position were measured for each nozzle in the X-direction (the lining-up direction of the nozzles and the juxtaposing direction of the heating resistors) and the Y-direction (the direction perpendicular to the X-direction). FIG. 19 shows displacements by plotting the displacement of the ink landing position in the X-direction in the abscissa and the displacement of the ink landing position in the Y-direction in the ordinate.

As is understood from these graphs, in the printer-head chip having the heating resistor divided into two, the ink landing position is displaced in the X-direction rather than in the Y-direction.

In FIG. 13, the range of the ink ejecting displacement for each nozzle is expressed by a phantom line. If the ink landing position is displaced in the X-direction, the ink landing displacement range forms an ellipse longitudinally extended in the lining-up direction of the nozzles. If a plurality of such printer-head chips are arranged to form a line head, white stripes or stripes may be liable to be produced, as described above.

SUMMARY OF THE INVENTION

Accordingly, it is a problem to be solved by the present invention that in a liquid ejecting apparatus having a plurality of chips arranged in a specific direction, each chip having a plurality of liquid ejection units juxtaposed in the specific direction, such as a line head, variations in liquid landing positions in the specific direction are reduced.

The problem described above is solved by the following solving means according to the present invention.

In accordance with an aspect of the present invention, a liquid ejection apparatus comprises a plurality of chips arranged in a specific direction, each chip comprising a plurality of liquid ejection units juxtaposed in the specific direction, wherein each of the plurality of chips has a configuration that the displacement between ejection directions of liquid ejected from the respective liquid ejection units is minimized in the specific direction.

In the invention according to the aspect, since the displacement between ejection directions of liquid ejected from the respective liquid ejection units is minimized in the specific direction, that is in the direction of the juxtaposed liquid ejection units, the displacement of the liquid landing position between liquid ejection units and between chips can be reduced as small as possible.

In accordance with another aspect of the present invention, a liquid ejection apparatus comprises a plurality of chips arranged in a specific direction, each chip comprising a plurality of liquid ejection units juxtaposed in the specific direction, wherein each of the plurality of chips has a configuration that the displacement between ejection directions of liquid from the respective liquid ejection units is minimized in the specific direction, and wherein the liquid ejection apparatus comprises ejection timing controlling means capable of establishing ejection timing of liquid from the liquid ejection units of each chip for each chip in order to correct the displacement of the liquid landing position between the chips in a moving direction of a target object to be ejected relatively to the chips when liquid is ejected on the target object moving relatively to the chips in a direction being different from the specific direction and including a direction perpendicular to the specific direction.

In the invention according to the second aspect, since the displacement between ejection directions of liquid ejected from the respective liquid ejection units is minimized in the specific direction, that is in the direction of the juxtaposed liquid ejection units, in the same way as the first aspect of the invention, the displacement of the liquid landing position between liquid ejection units and between chips can be reduced as small as possible.

Moreover, since the displacement of the liquid landing position between chips in a direction being different from the specific direction and including a direction perpendicular to the specific direction is corrected by the ejection timing controlling means, the ejection timing of liquid from the liquid ejection units of each chip is established for each chip.

Accordingly, the displacement of the liquid landing position not only in the specific direction but also in a direction being different from the specific direction and including a direction perpendicular to the specific direction can be reduced.

DESCRIPTION OF THE PREFERRED EMBODIMENTS

Embodiments according to the present invention will be described below with reference to the drawings.

(First Embodiment)

Figure 1:
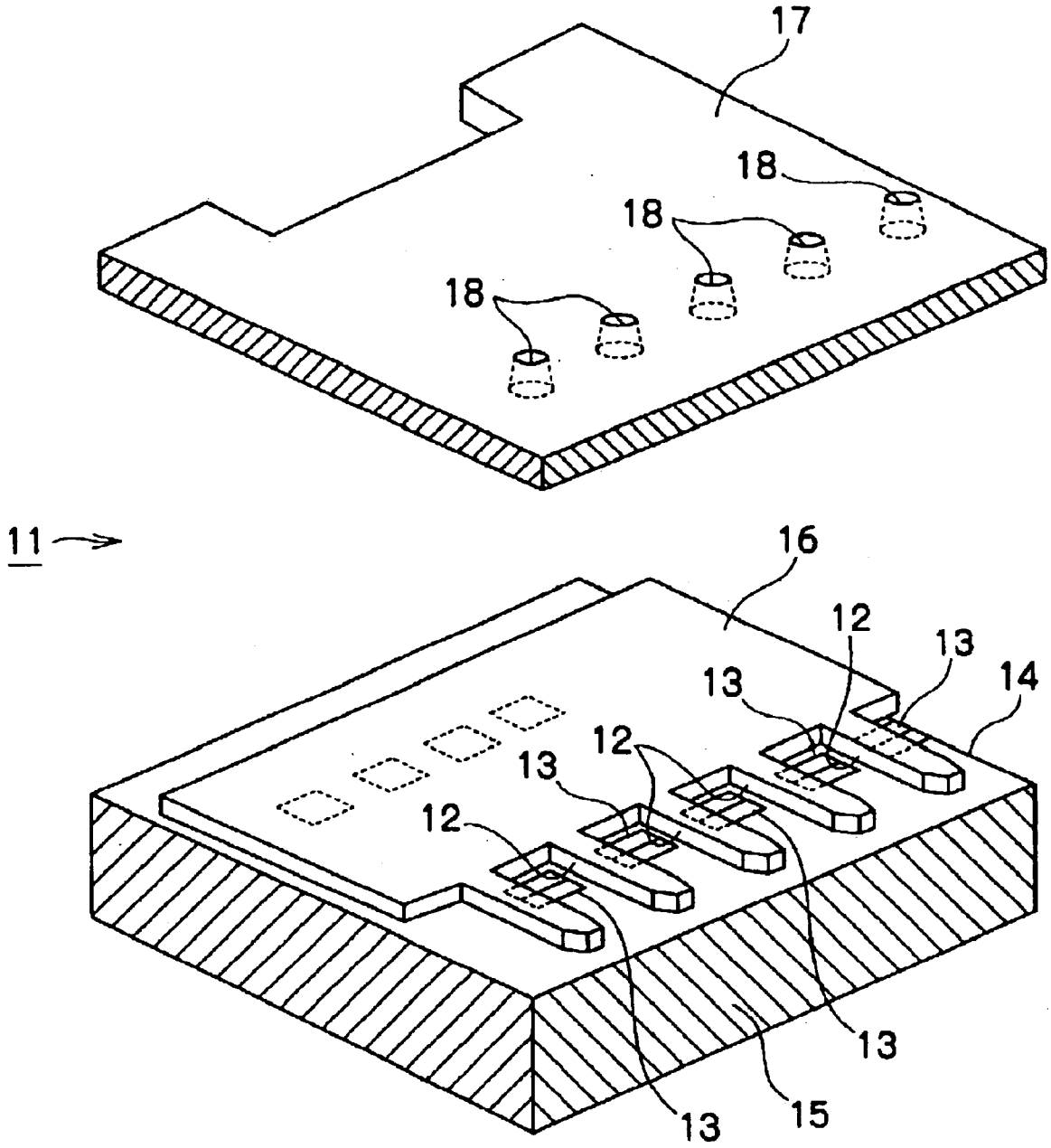
FIG. 1 is an exploded perspective view of a printer-head chip constituting a printer-head chip incorporated in a liquid ejection apparatus according to the present invention.

FIG. 1 is an exploded perspective view of a printer-head chip 11 constituting a printer head incorporated in a liquid ejection apparatus according to the present invention. FIG. 1 shows a nozzle sheet 17 to be bonded on a barrier layer 16, in which the nozzle sheet 17 is shown in an exploded state.

The printer-head chip 11 is of the thermal system mentioned above. A substrate member 14 of the printer-head chip 11 includes a silicon semi-conductor substrate 15 and heating resistors (equivalent to energy generating means according to the present invention) 13 deposited on one surface of the semi-conductor substrate 15. The heating resistor 13 is electrically connected to an external circuit via a conductor (not shown) formed on the semi-conductor substrate 15.

The barrier layer 16, made of a photosensitive cyclized-rubber resist or an exposure-curing dry film resist, for example, is deposited on the entire surface of the semi-conductor substrate 15, on which the heating resistors 13 are formed, and then unnecessary parts are removed by a photolithography process.

Furthermore, the nozzle sheet 17, having a plurality of nozzles 18 formed thereon, is made by nickel electro-casting and bonded on the barrier layer 16 so that positions of the nozzles 18 agree with positions of the heating resistors 13, i.e., the nozzle 18 opposes the heating resistor 13.

An ink liquid chamber (equivalent to a liquid chamber according to the present invention) 12 is constituted of the substrate member 14, the barrier layer 16, and the nozzle sheet 17 so as to surround the heating resistor 13. That is, in the drawing, the substrate member 14 constitutes a bottom wall of the ink liquid chamber 12; the barrier layer 16 constitutes a sidewall of the ink liquid chamber 12; and the nozzle sheet 17 constitutes a ceiling wall of the ink liquid chamber 12. Thereby, the ink liquid chamber 12 has an open surface in front of the right of FIG. 1, and the opening is communicated with an ink flow path (not shown).

In addition, for one ink liquid chamber, two heating resistors 13 are juxtaposed, and this will be described later.

Each of the printer-head chips 11 described above comprises a plurality of the heating resistors 13, generally in 100 units, and the ink liquid chambers 12 having the respective heating resistors 13. By a command from a printer control unit, each of the heating resistors 13 is uniquely selected, and ink within the ink liquid chamber 12 corresponding to the selected heating resistor 13 can be ejected from the nozzle 18 opposing the ink liquid chamber 12.

That is, in the printer-head chip 11, the ink liquid chamber 12 is filled with ink from an ink tank (not shown) attached to the printer-head chip 11. By providing a pulse electric current through the heating resistor 13 for a short time, for 1 to 3 microseconds, for example, the heating resistor 13 is rapidly heated. As a result, a vapor-phase ink bubble is generated in an ink portion placed in contact with the heating resistor 13 so as to displace some volume of ink by expansion of the ink bubble. Thereby, part of ink placed in contact with the nozzle 18 and having the same volume as that of the displaced ink is ejected from the nozzle 18 as an ink drop so as to land on printing paper.

Figure 2:
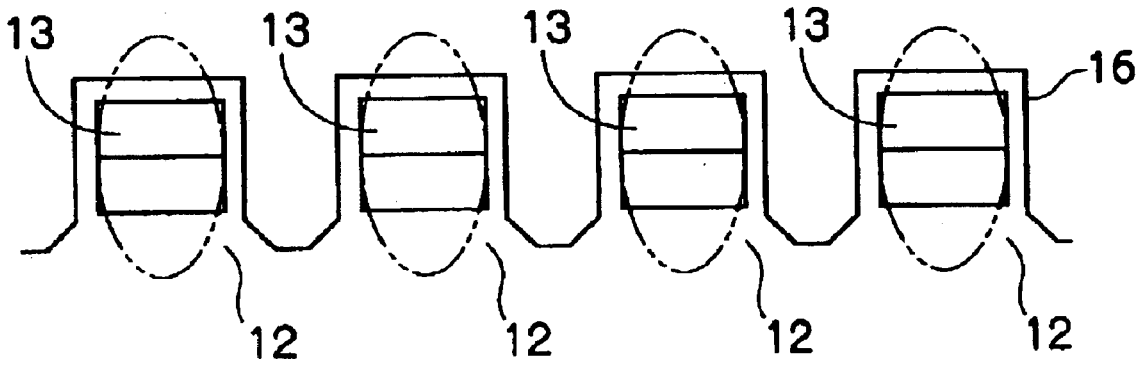
FIG. 2 is a plan view of the printer-head chip shown by removing a nozzle sheet therefrom so as to show the arrangement of heating resistors in more detail.

FIG. 2 is a plan view of the printer-head chip 11 shown by removing the nozzle sheet 17 therefrom so as to show the arrangement of the heating resistors 13 in more detail.

Figure 13:
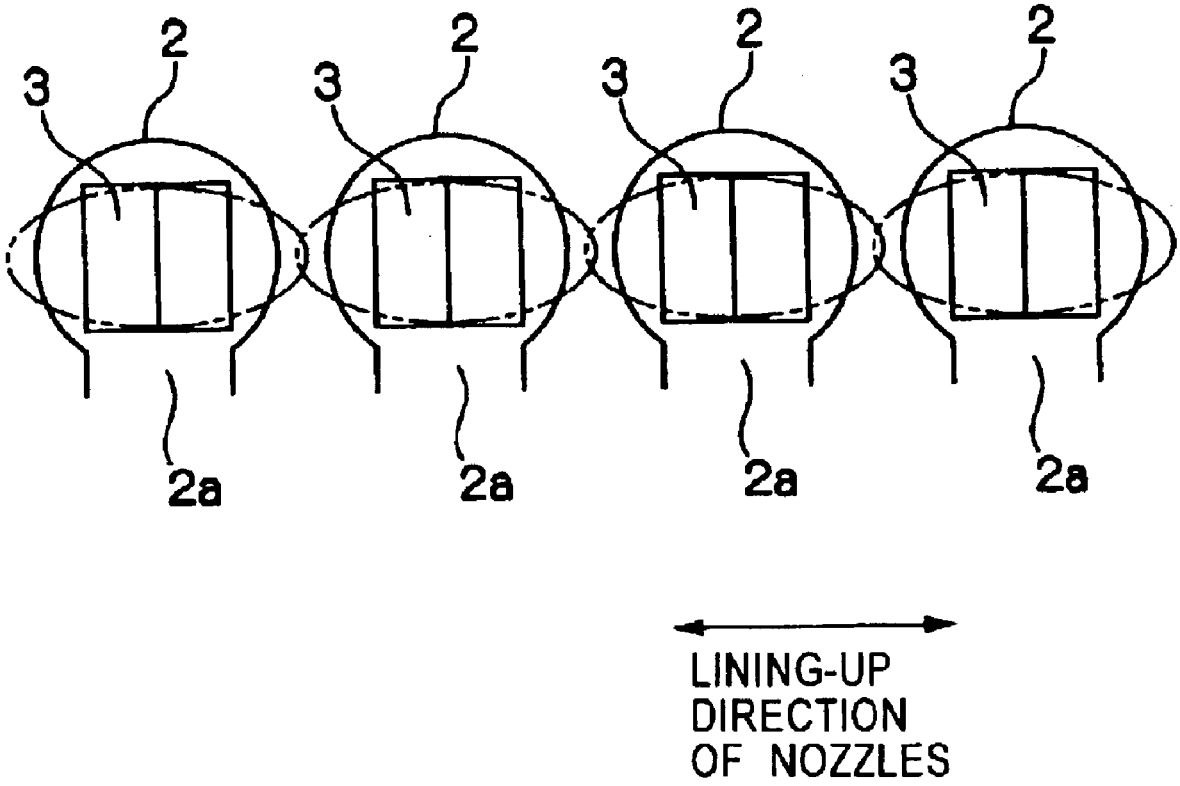
FIG. 13 is a plan view of an example having two-divided heating resistors within one ink liquid chamber.
Figure 14:
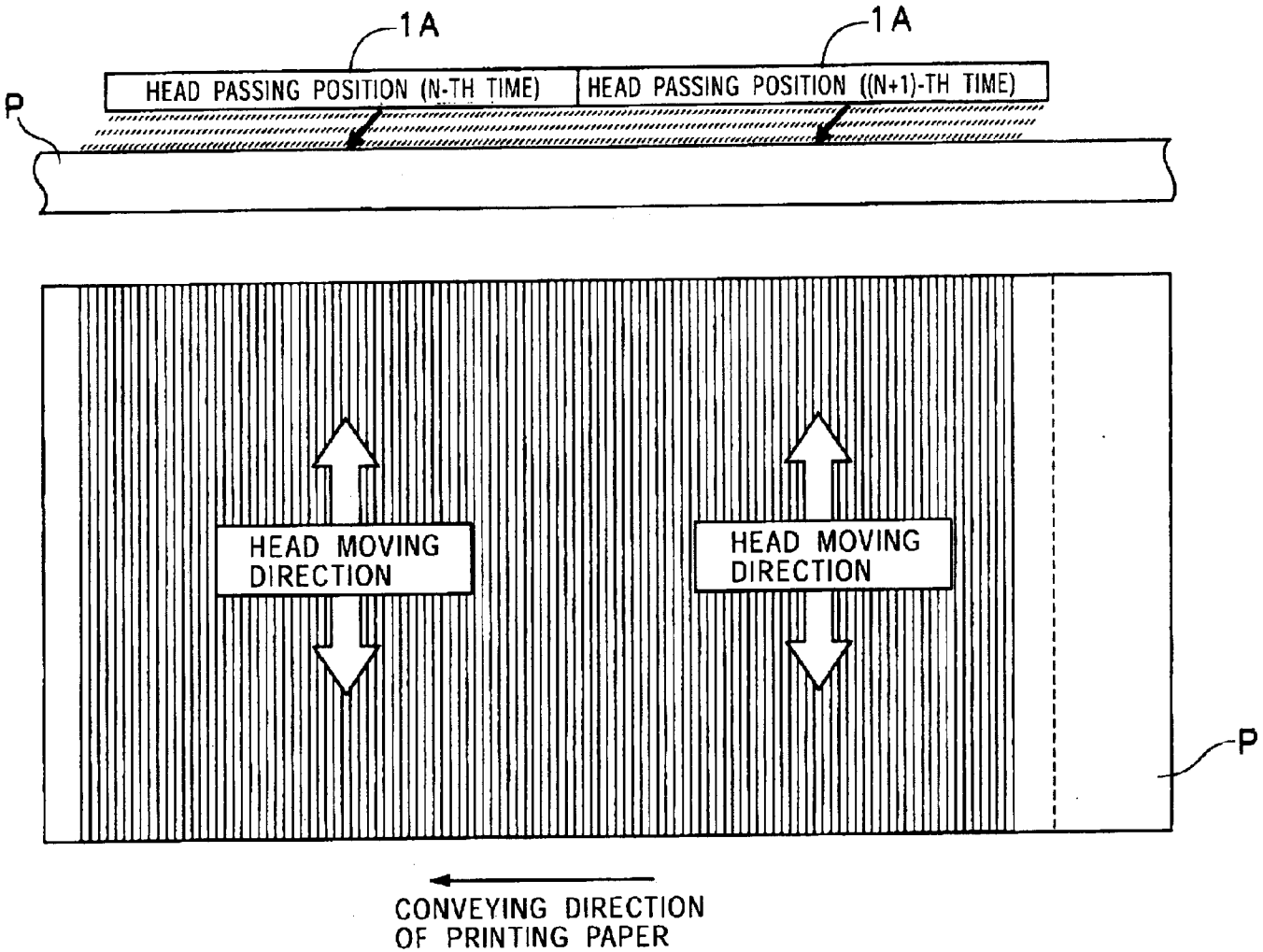
FIG. 14 includes a sectional view and a plan view, showing an image-printing state using a head having one printer-head chip in a serial system.
Figure 15:
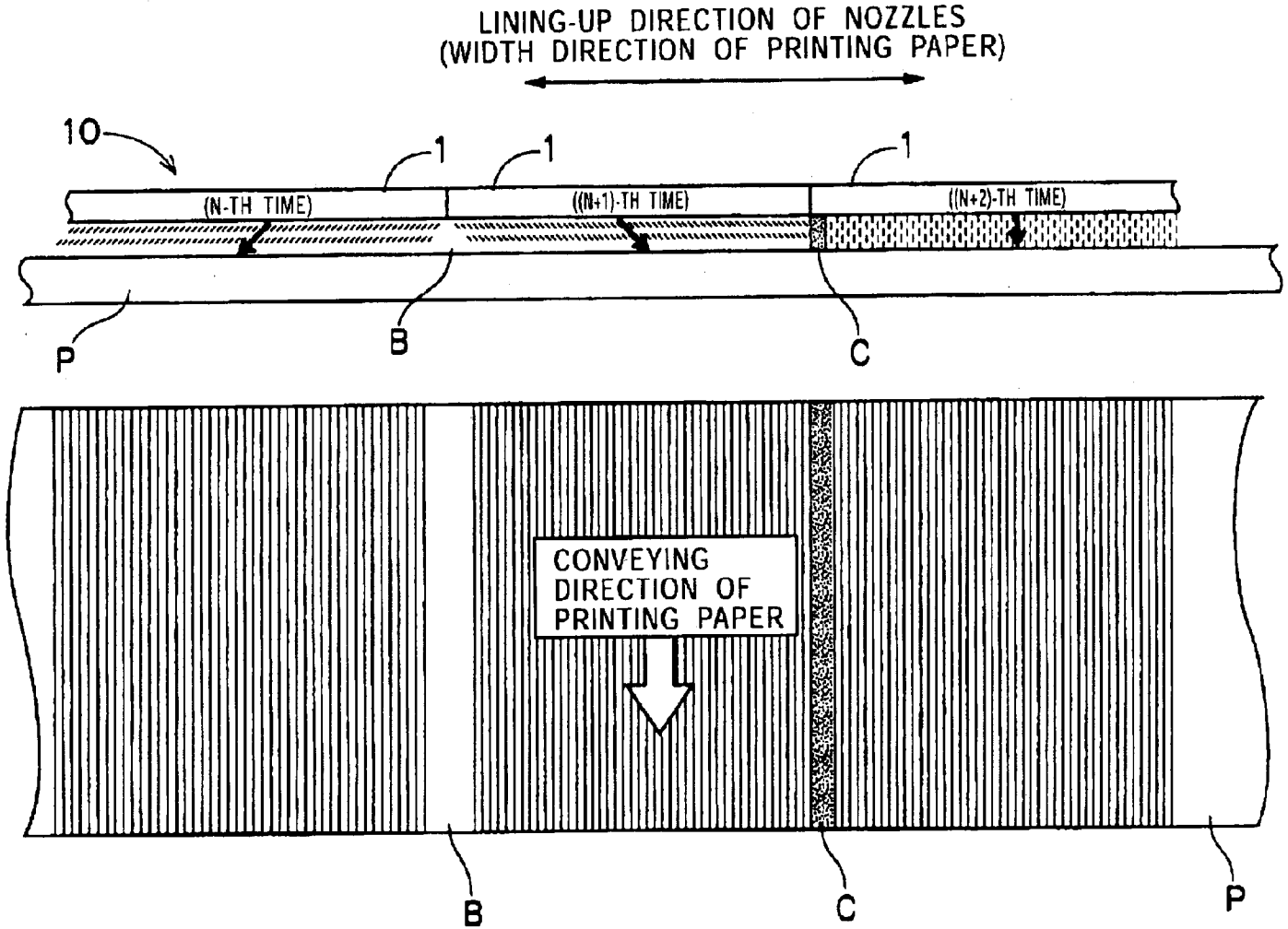
FIG. 15 includes a sectional view and a plan view, showing an image-printing state in the line head.
Figure 16:
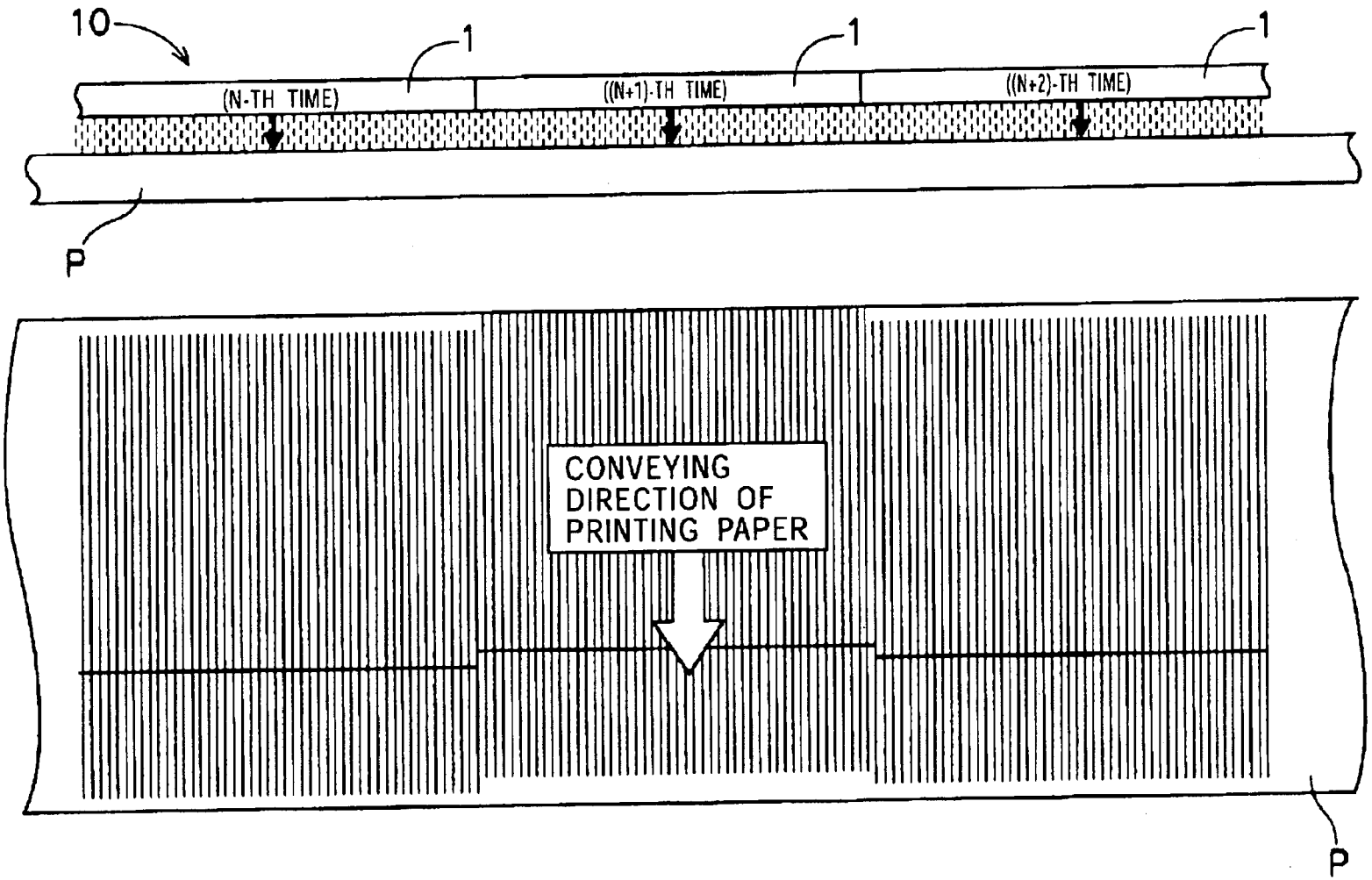
FIG. 16 includes a sectional view and a plan view, showing an image-printing state in the line head.
Figure 17:
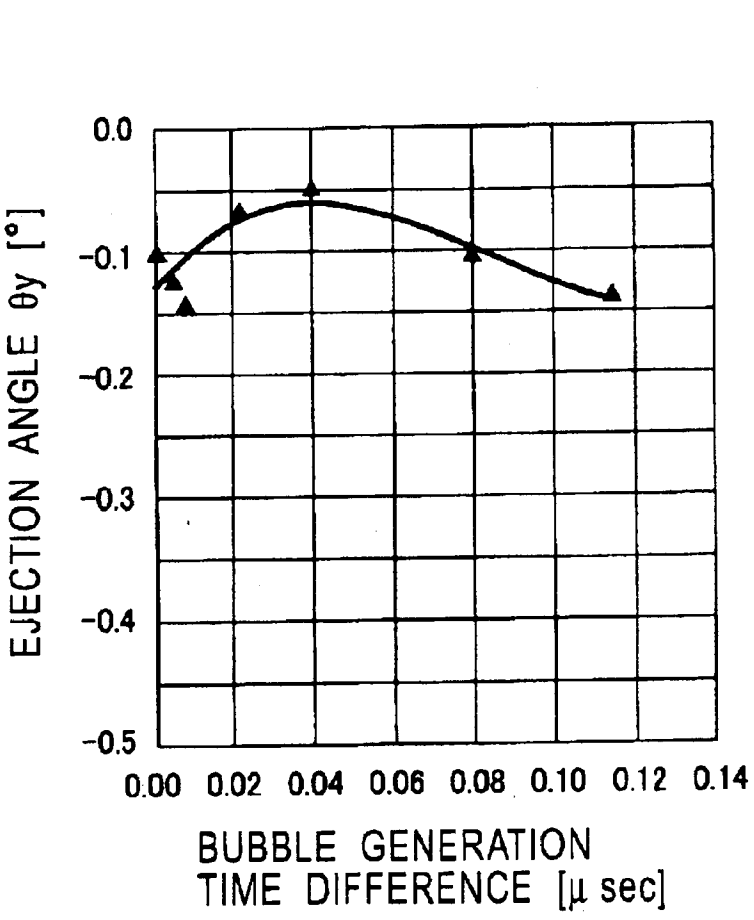
FIG. 17 includes graphs showing a relationship between a time difference until ink bubbles are produced by each heating resistor and an ink ejection angle, when divided heating resistors are provided.
Figure 17:
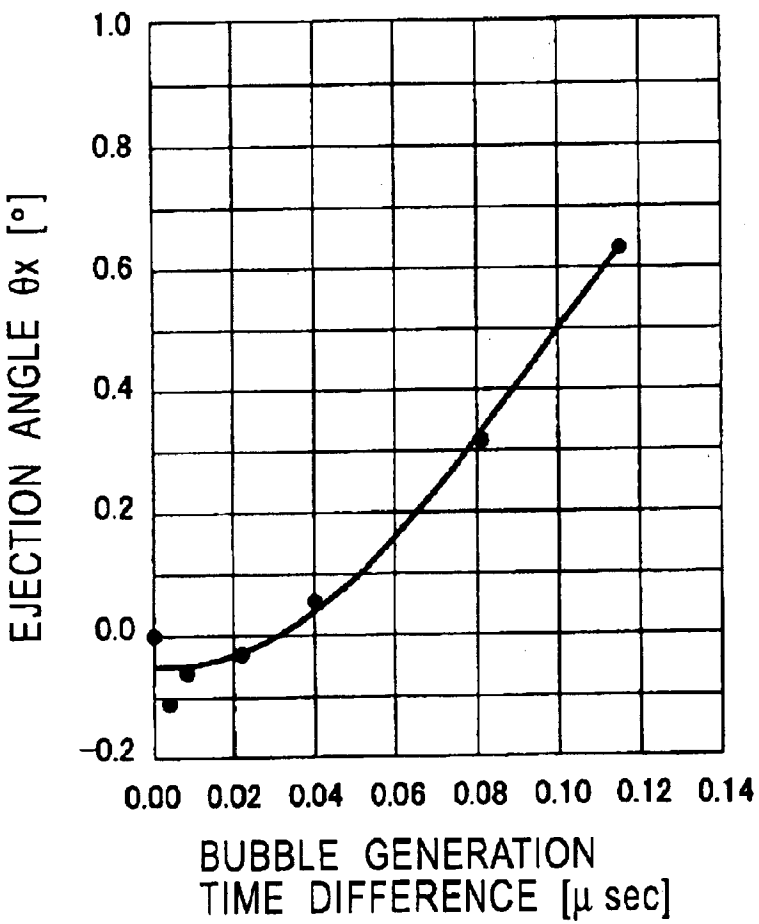
Figure 18:
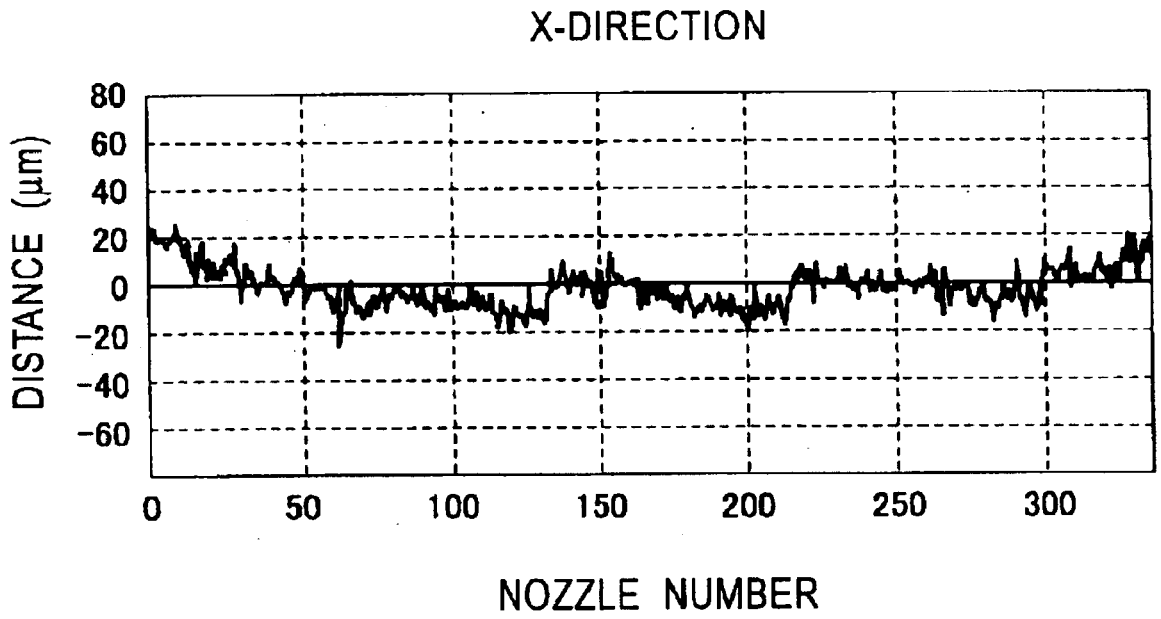
FIG. 18 includes graphs showing actual measurements obtained from an actually manufactured printer-head chip with each ink liquid chamber having a heating resistor divided into two.
Figure 18:
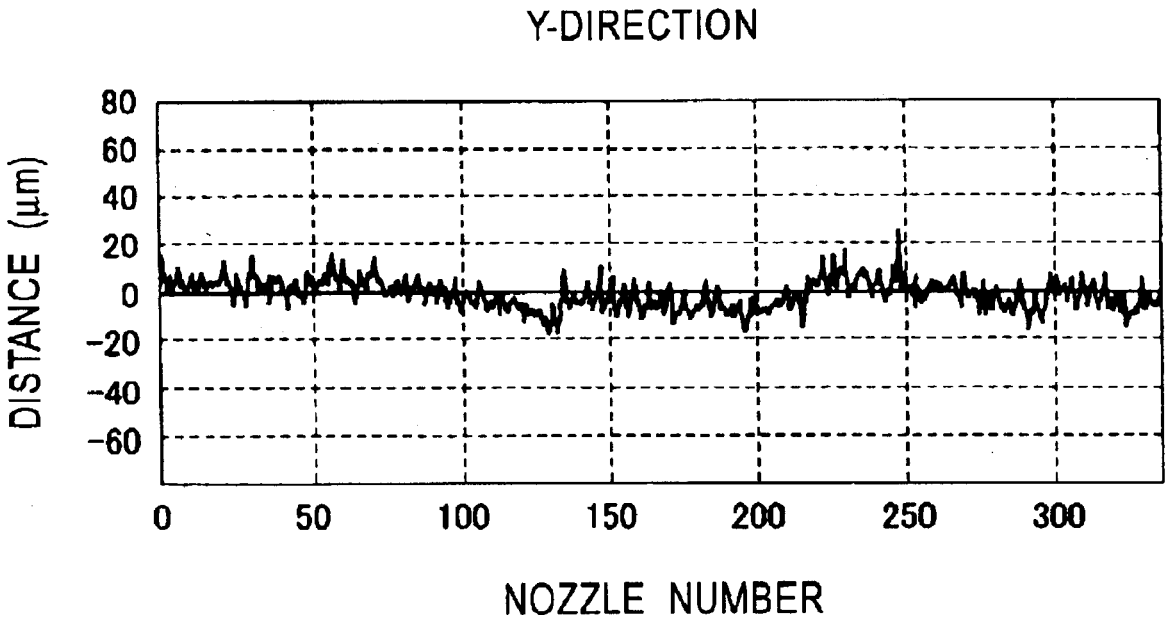
Figure 19:
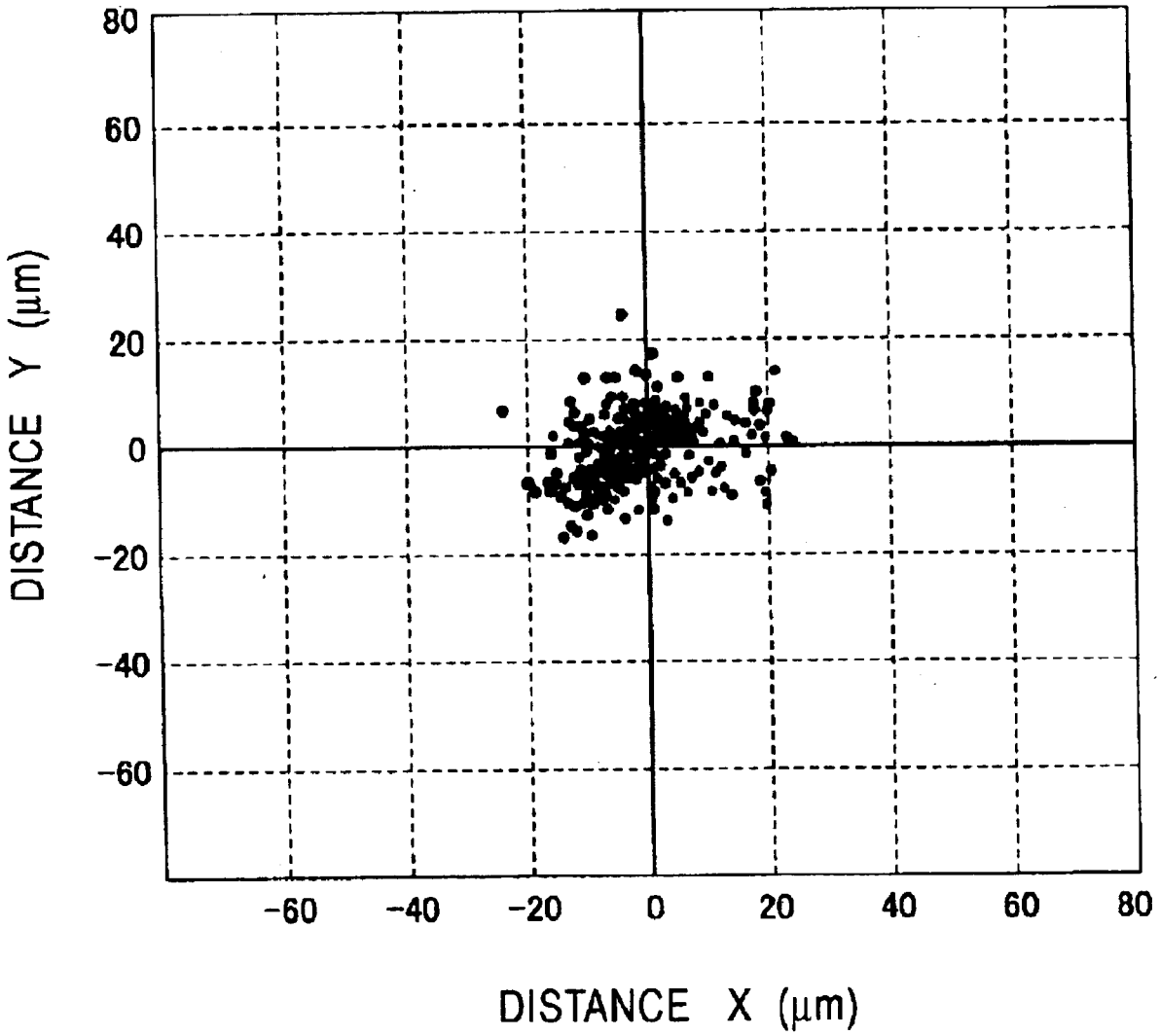
FIG. 19 is a graph showing actual measurements obtained from the actually manufactured printer-head chip with each ink liquid chamber having the heating resistor divided into two.

As shown in FIG. 2, each ink liquid chamber 12 is provided with the heating resistor 13 divided into two. The two-divided heating resistors 13 shown as the conventional example (FIG. 13) were juxtaposed in the lining-up direction of the nozzles. Whereas according to the embodiment, the heating resistors 13 are juxtaposed in a direction perpendicular to the lining-up direction of the nozzles 18.

In the conventional example, it has been described that the ink landing positions are displaced in the lining-up direction of the nozzles because of the heating timing of the heating resistors 3. However, when the divided heating resistors 13 are juxtaposed in the direction according to the embodiment, the ink landing positions are difficult to be displaced in the lining-up direction of the nozzles 18, while being displaced in a direction perpendicular to the lining-up direction of the nozzles 18. In FIG. 2, the range of the landing displacements of ink ejected from each ink liquid chamber is expressed by a phantom line; in which, different from FIG. 13, the ink landing displacement range forms an ellipse having a longitudinal direction perpendicular to the lining-up direction of the nozzles 18.

Figure 12:
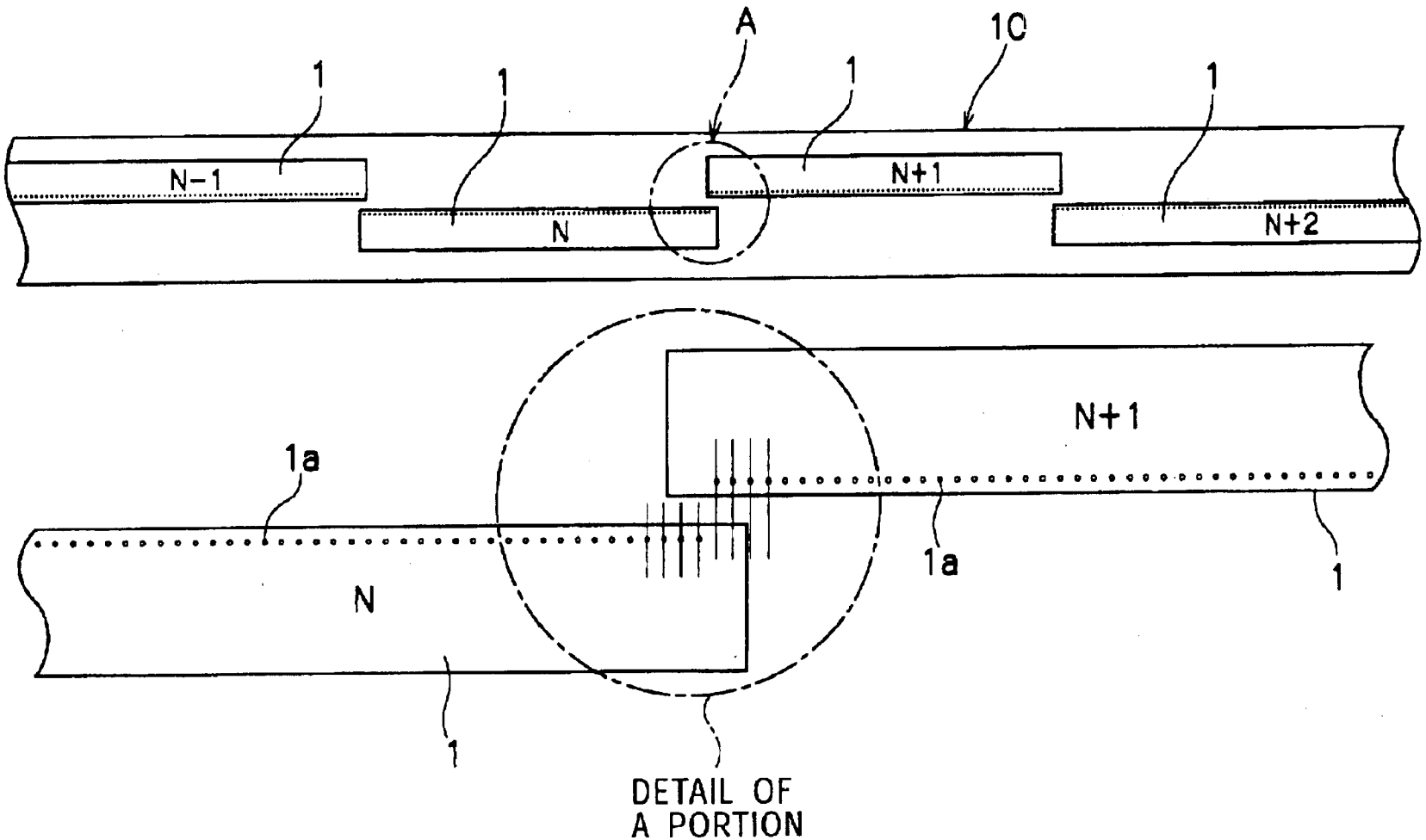
FIG. 12 is a plan view of a line head.

By arranging a plurality of the printer-head chips 11 according to the embodiment in the lining-up direction of the nozzles 18, the line head can be formed in the same way as shown in FIG. 12.

When the plurality of the printer-head chips 11 are juxtaposed as mentioned above, the ink ejecting direction is different between adjacent printer-head chips 11, as described as the problem in the conventional technique, so that white stripes or stripes may be produced between the printer-head chips 11.

Whereas if the heating resistors 13 are arranged according to the embodiment, in the lining-up direction of the nozzles 18 (juxtaposing direction of the printer-head chips 11), the displacement of ink landing positions is minimized while in the direction perpendicular to the lining-up direction of the nozzles 18, the displacement of ink landing positions is maximized.

Therefore, stripes due to the landing position displacement between adjacent printer-head chips 11 can be reduced.

Figure 3:
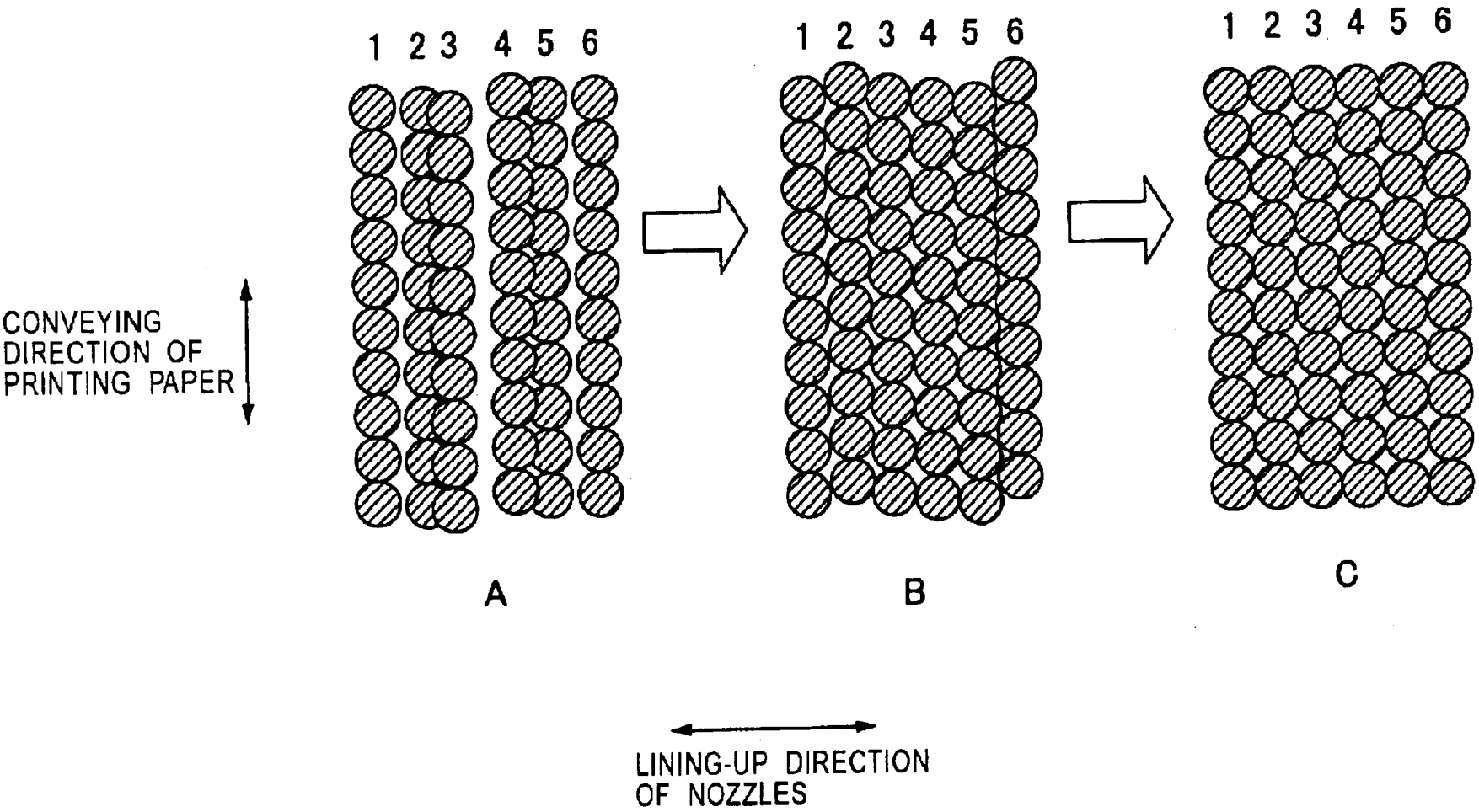
FIG. 3 is a drawing for illustrating changes in ink landing positions when an embodiment according to the present invention is incorporated in a line head.

FIG. 3 includes drawings for illustrating changes in ink landing positions when the present embodiment is incorporated in the line head. In FIG. 3, the left drawing A shows the ink landing positions of a conventional system (prior to the incorporation of the embodiment); and the central drawing B shows the ink landing positions in the structure described above.

In the conventional system, the ink landing positions are displaced in the lining-up direction of the nozzles (the right and the left direction in the drawing). In the drawing A, an example is shown in that the second and the sixth ink landing positions are displaced in the right while the third ink landing positions are displaced in the left.

Whereas in the structure according to the embodiment, the ink landing positions are scarcely displaced in the lining-up direction of the nozzles. However, since the ink landing positions are set to displace in the direction perpendicular to the lining-up direction of the nozzles 18 (transferring direction of printing paper), as shown in the drawing B, the ink landing positions are displaced in the direction perpendicular to the lining-up direction of the nozzles 18. In the drawing B, an example is shown in that the second and the sixth ink landing positions are displaced upward while the fourth and the fifth ink landing positions are displaced downward.

Since such displacement of ink landing positions in the direction perpendicular to the lining-up direction of the nozzles 18 does not produce longitudinal stripes, it is not noticed so much as that in the lining-up direction of the nozzles 18; however, a surge or edge indentations which may be produced depending on the degree of the displacement, may be produced. Therefore, according to the embodiment, the displacement of landing positions is further controlled and reduced, as shown finally in the right drawing C, so that there is provided ejection timing control means for aligning ink-landing positions also in the direction perpendicular to the lining-up direction of the nozzles 18.

Figure 4:
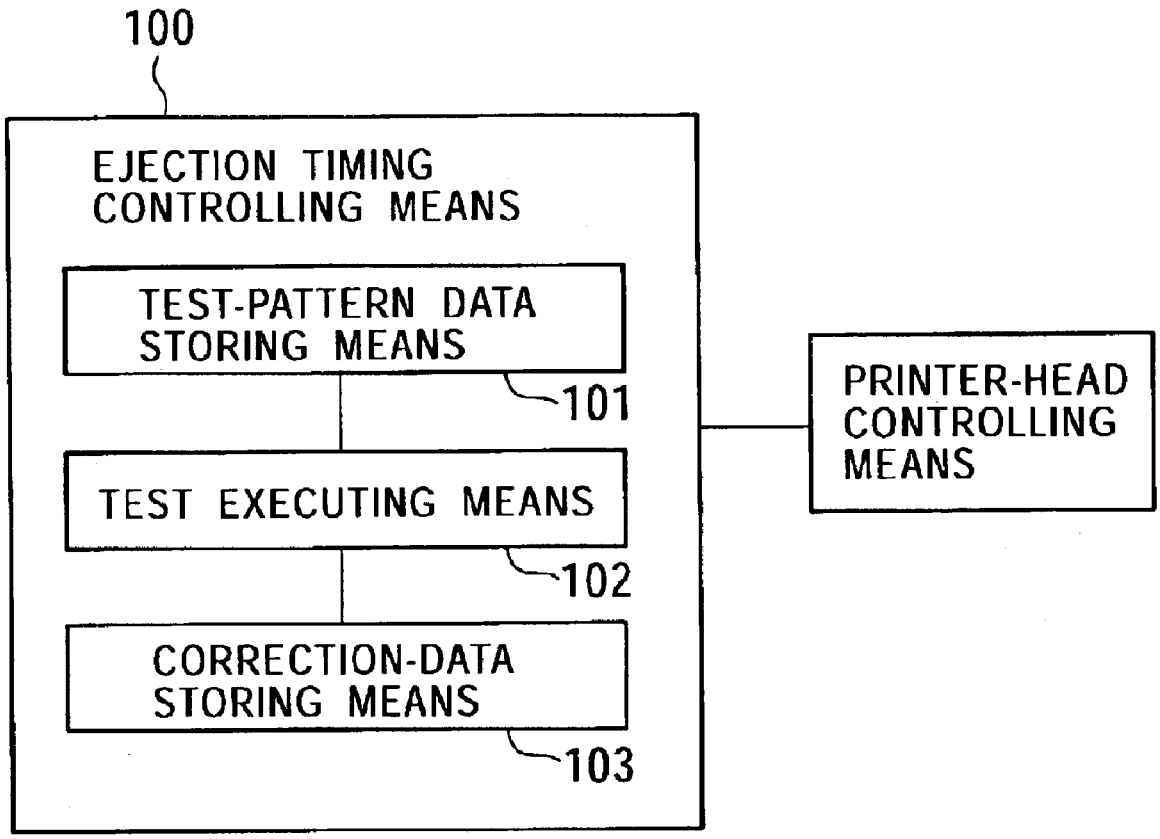
FIG. 4 is a block diagram of a configuration of ejection timing control means.
Figure 5:
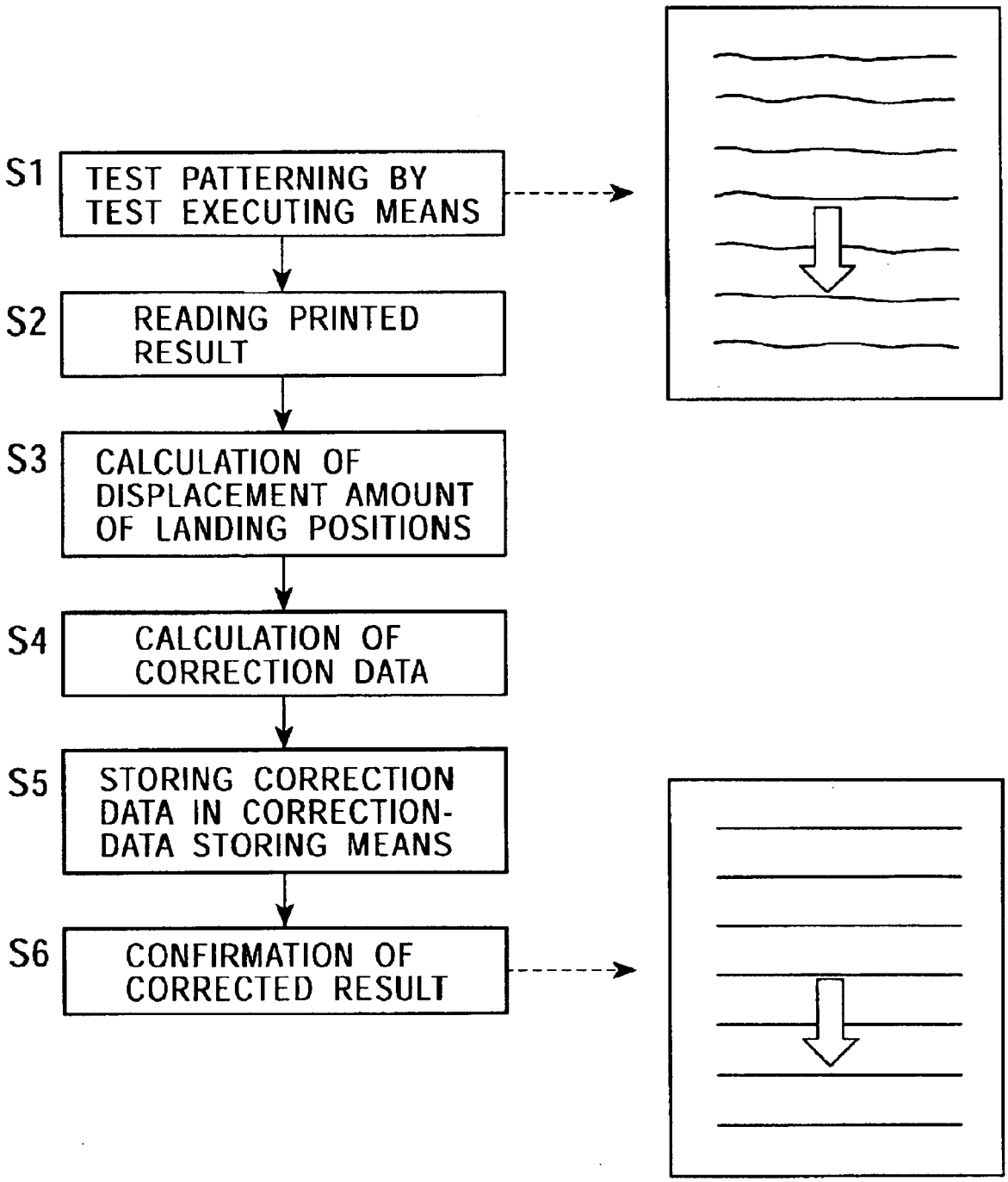
FIG. 5 is a drawing for illustrating a method for reducing the displacement of ink landing positions in the transferring direction of printing paper, using the ejection timing control means.

FIG. 4 is a block diagram of the configuration of ejection timing control means 100. FIG. 5 is a flow diagram for illustrating a method for reducing the displacement of ink landing positions in the transferring direction of printing paper, using the ejection timing control means 100.

Referring to FIG. 4, the ejection timing control means 100 is electrically connected to printer head control means for generally controlling the printer head driving, which particularly controls ink ejection timing in the printer head control. In more particular, in order to correct the displacement of ink landing positions in the transferring direction of printing paper when ink is ejected on the printing paper, the ejection timing control means 100 establishes the ink ejection timing from the nozzles 18 of each printer-head chip 11 so as to be different for each of the printer-head chip 11.

The ejection timing control means 100 is provided with test-pattern data storing means 101, test executing means 102, and correction data storing means 103, as follows.

The test-pattern data storing means 101 stores test pattern data for ejecting ink from at least one nozzle 18 of the printer-head chip 11 selected from the printer-head chips 11, and is provided in a predetermined memory. According to the embodiment, the test pattern is a pattern for printing a straight line extending in the lining-up direction of the nozzles 18.

The test pattern may print a straight line by selecting the entire printer-head chips 11; alternatively, it may print the straight line by selecting a printer-head chip 11 having a predetermined ordinal number from the printer-head chips 11.

The test executing means 102 reads test pattern data stored in the test-pattern data storing means 101, and then ejects ink according to the test pattern data, while repeating the ink ejection plural times according to the same test-pattern data.

The reason for repeating the ink ejection plural times according to the same test-pattern data is that test accuracies are improved by statistically processing test results obtained from plural times testing in order to eliminate accidental constituents. That is, if test pattern printing is performed only one time, accidental displacement due to dirt, dust, or bubbles may affects the results.

According to the embodiment, the test executing means 102, as shown in Step S1 of FIG. 5, prints a straight line with each printer-head chip 11. If part of the printer-head chip 11 causes the displacement of the ink landing position, as shown in the right of Step S1, a precise straight line cannot be obtained at the position.

Next, the images printed by the test executing means 102 are read by an image scanner for example (Step S2). Then, the resultant data is processed by a computer prepared in advance so as to calculate the tendentious displacement amount of the landing position (Step S3). From the data read by the image scanner, it can be detected which printer-head chip 11 having an ordinal number prints the line by the calculation of the distance from the left end, for example. Furthermore, the average position of the lines printed by the respective printer-head chips 11 in the conveying direction of printing paper is calculated, and by putting the average position in contrast with the line position printed by each printer-head chip 11, it can be calculated that which printer-head chip 11 has the displacement deviation of the landing position from the average position.

When the displacement deviation of the landing position from the average position of each printer-head chip 11 is calculated, the correction data corresponding to the displacement deviation of the landing position is calculated (Step S4). The correction data is for showing the necessary time deviation of the ink ejection timing of each printer-head chip 11. That is, according to the embodiment; the timing of sending a printing command is differentiated corresponding to each printer-head chip 11.

Then, the correction data is stored in the correction data storing means 103 (Step S5). The correction data storing means 103 is arranged in a predetermined memory in the same way as in the test-pattern data storing means 101.

Thereby, the ejection timing control means 100 is enabled to control the ink ejection timing from each printer-head chip 11 according to the correction data stored in the correction data storing means 103.

In order to confirm the corrected result, the test executing means 102 performs the test pattern printing again according to the correction data (Step S6). If the correction data is correctly reflected, a straight line can be printed with high-accuracies, and as shown in the right of Step S6, the linearity, which is partly turbulent prior to the correction, is modified.

(Second Embodiment)

Figure 6:
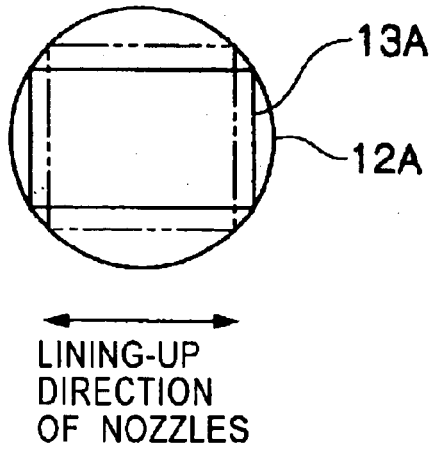
FIG. 6 is a plan view of a second embodiment according to the present invention, showing shapes of an ink liquid chamber and a heating resistor.

FIG. 6 is a plan view of a second embodiment according to the present invention, showing shapes of an ink liquid chamber 12A and a heating resistor 13A.

The planar region of the ink liquid chamber 12 according to the first embodiment is substantially square; whereas the ink liquid chamber 12A according to the second embodiment has a circular planar region. In such a manner, the ink liquid chamber may be rectangular or circular. In the region of the ink liquid chamber 12A, the heating resistor 13A is arranged.

The heating resistor 13A is formed to have a longitudinal direction in the line-up direction of nozzles. An outline of a general square heating-resistor is shown by a phantom line as a reference.

In such a manner, according to the second embodiment, the heating resistor 13A is formed to have a longitudinal direction in the line-up direction of nozzles. As described above, in the bonding to the nozzle sheet, the displacement between the nozzle and the heating resistor becomes a problem; whereas according to the second embodiment, even when the position of the nozzle is displaced to some extent in the longitudinal direction of the heating resistor 13A, changes in ink ejection angle can be reduced because the heating resistor 13A is securely arranged under the nozzle.

According to the embodiment, since the length of the heating resistor 13A in the direction perpendicular to the lining-up direction of nozzles is smaller than that of a conventional square heating-resistor shown by the phantom line, changes in ink ejection angle relative to the positional displacement of the nozzle become larger in this direction.

Thereby, the configuration can be established to minimize displacement of ink landing positions in the lining-up direction of nozzles and to allow the displacement to be generated in a direction perpendicular to the lining-up direction of nozzles.

(Third Embodiment)

Figure 7:
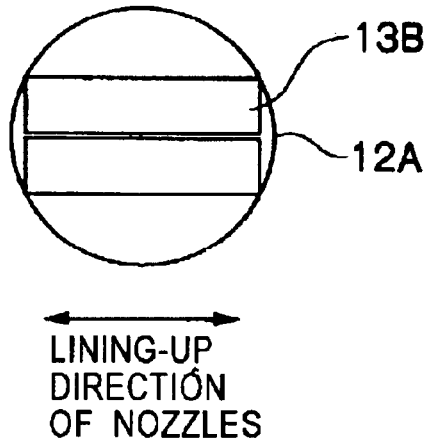
FIG. 7 is a plan view of a third embodiment according to the present invention, showing shapes of an ink liquid chamber and a heating resistor.

FIG. 7 is a plan view of a third embodiment according to the present invention, showing shapes of the ink liquid chamber 12A and a heating resistor 13B.

According to the third embodiment, the ink liquid chamber 12A has a circular region in the same way as in the second embodiment. The heating resistor 13B is divided into two in a direction perpendicular to the lining-up direction of nozzles in the same way as in the first embodiment.

In the heating resistor 13 according to the first embodiment, the region, in which two-divided resistors 13 are placed end to end, is substantially square-shaped; whereas according to the third embodiment, the region, in which two-divided resistors 13B are placed end to end, is rectangular-shaped and having a longitudinal direction in the line-up direction of nozzles as in the second embodiment.

In such a structure, it also can be established to minimize displacement of ink landing positions in the lining-up direction of nozzles and to allow the displacement to be generated in a direction perpendicular to the lining-up direction of nozzles.

(Fourth Embodiment)

Figure 8:
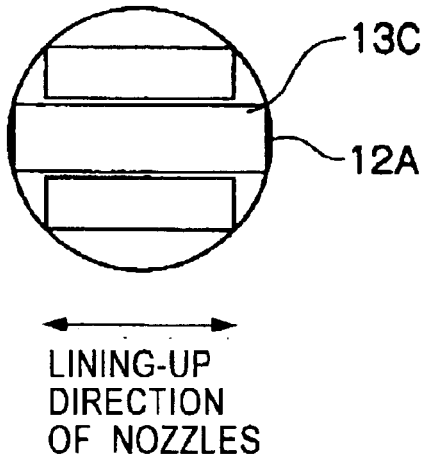
FIG. 8 is a plan view of a fourth embodiment according to the present invention, showing shapes of an ink liquid chamber and a heating resistor.

FIG. 8 is a plan view of a fourth embodiment according to the present invention, showing shapes of the ink liquid chamber 12A and a heating resistor 13C.

According to the fourth embodiment, the ink liquid chamber 12A has a circular region in the same way as in the second and the third embodiment. Furthermore, the heating resistor 13C is divided into three in a direction perpendicular to the lining-up direction of nozzles. When the resistor is divided, it is not limited to be divided into two, and it may be divided into three, as the heating resistor 13C. If divided into three, it is not necessary to equalize lengths in the longitudinal direction, as in this embodiment. According to the embodiment, the central resistor 13C is longer in the longitudinal direction than the other upper and lower resistors so as to agree with the region of the ink liquid chamber 12A.

(Fifth Embodiment)

Figure 9:
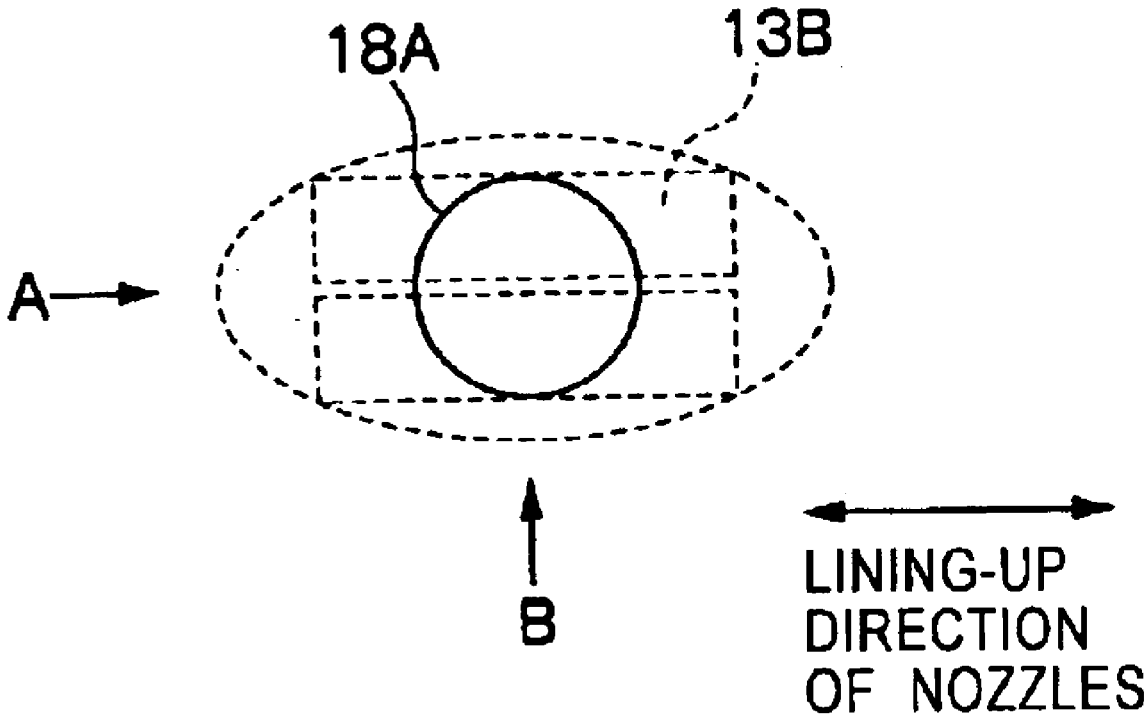
FIG. 9 is a plan view of a fifth embodiment according to the present invention.
Figure 10:
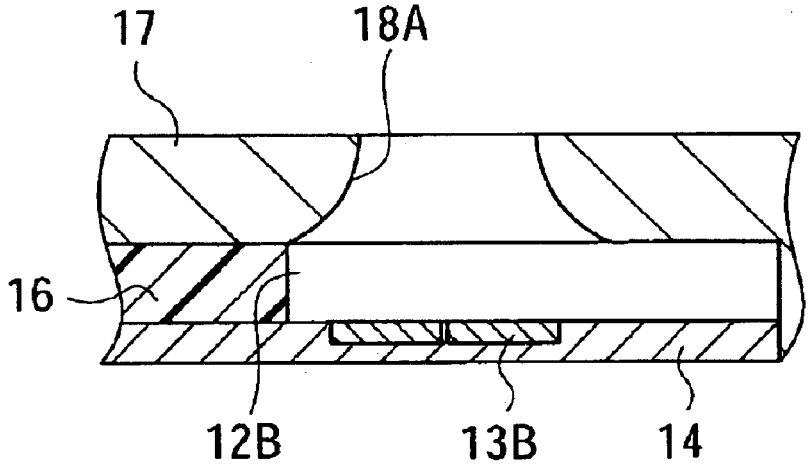
FIG. 10 is a sectional view (side view) of FIG. 9 viewed in an arrow A direction, showing the fifth embodiment according to the present invention.
Figure 11:
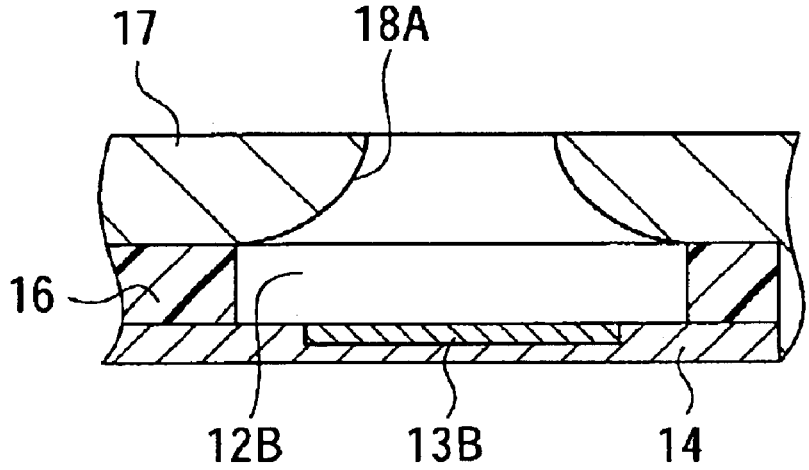
FIG. 11 is a sectional view (front view) of FIG. 9 viewed in an arrow A direction, showing the fifth embodiment according to the present invention.

FIGS. 9 to 11 are drawings showing a fifth embodiment of the present invention: FIG. 9 is a plan view; FIG. 10 is a sectional view (side view) of FIG. 9 viewed in an arrow A direction; and FIG. 11 is a sectional view (front view) of FIG. 9 viewed in an arrow B direction.

According to the fifth embodiment, the nozzle sheet 17 has nozzles 18A different from the nozzles 18 according to the first embodiment. An upper opening of the nozzle 18A is circular-shaped as in the first embodiment; whereas a lower opening (nearer to the heating resistor 13B) is elliptical-shaped and having a longitudinal direction in the line-up direction of nozzles.

The ink liquid chamber 12B is communicated with the nozzle 18A and has an elliptical cross-section identical to the shape of the lower opening of the nozzle 18A. The heating resistor 13B is divided into two in a direction perpendicular to the lining-up direction of nozzles in the same way as in the third embodiment shown in FIG. 7, while the region, in which two-divided resistors 13B are placed end to end, is rectangular-shaped and having a longitudinal direction in the line-up direction of nozzles.

In such a structure, it may also be established to minimize displacement in ink landing positions in the lining-up direction of nozzles and to allow the displacement to be generated in a direction perpendicular to the lining-up direction of nozzles, in the same way as in the embodiments described above.

In addition, as shapes of the nozzle other than these according to the embodiment, while the upper opening of the nozzle is circular-shaped, the lower opening may be rectangular-shaped and having a longitudinal direction in the line-up direction of nozzles, for example. The region of the ink liquid chamber may be rectangular-shaped.

The embodiments according to the present invention have been described as above; however, the present invention is not limited to these embodiments so that various modifications may be made as follows, for example.

(1) The embodiments exemplify the heating resistor divided in the line-up direction of nozzles, the ink liquid chamber with a region having a longitudinal direction in the line-up direction of nozzles, and the heating resistor formed to have a longitudinal direction in the line-up direction of nozzles; alternatively, any modification may be made as long as it combines one or more of the above structures therewith.

(2) The thermal printer-head chip 11 has been described according to the embodiments; alternatively, an electrostatic ejection system and a piezoelectric system may be incorporated.

The electrostatic ejection system includes a diaphragm and two electrodes formed underneath the diaphragm with an air space therebetween, as energy generating means. The diaphragm is downward deflected by applying a voltage to between both the electrodes, and then the voltage is reduced to 0 V so as to release an electrostatic force. At this time, ink is ejected using an elastic force produced by the diaphragm returning back.

The piezoelectric system is a deposited layer of a piezoelectric element with electrodes formed on both surfaces of the element and a diaphragm, as energy generating means. If a voltage is applied to the electrodes formed on both surfaces of the piezoelectric element, a bending moment is produced on the diaphragm by a piezoelectric effect, so that the diaphragm is deflected. Using this deflection, ink is ejected.

(3) According to the embodiments, the line head having the printer-head chips 11 lined up in a line is exemplified; alternatively, the present invention may also be incorporated in the line head having color printer-head chips lined up in plural lines (printer-head chips 11 are arranged lengthwise and crosswise in blocks as a whole).

(4) According to the embodiments, in the direction perpendicular to the lining-up direction of the nozzles, the displacement of ink landing positions is maximized; however, it is not necessarily to be stringently in the direction perpendicular to the lining-up direction of the nozzles. For example, even if the displacement of ink landing positions is maximized in a direction deviated by an angle of about 10° from the direction perpendicular to the lining-up direction of the nozzles, the same advantages of the present invention can be obtained.

(5) According to the embodiments, the printer is exemplified; however, the present invention is not limited to the printer and various liquid ejection apparatuses may be applied thereto.

According to the present invention, the displacement of the liquid landing position in a specific direction, such as the displacement of the liquid landing position between liquid ejection units and between chips, can be reduced as small as possible. Thereby, white stripes and stripes are prevented from being produced so as to improve accuracies in the liquid landing position.

Since the displacement of the liquid landing position in a direction being different from the specific direction and including a direction perpendicular to the specific direction can be corrected, the displacement of the liquid landing position not only in the specific direction but also in a direction being different from the specific direction and including a direction perpendicular to the specific direction can be reduced. Thereby, accuracies in the liquid landing position can be furthermore improved.

What is claimed is:

1. A liquid ejection apparatus comprising a plurality of chips arranged in a first direction, each chip comprising a plurality of liquid ejection units disposed in the first direction, and each liquid ejection unit comprising a plurality of energy generating means, wherein each of the plurality of chips has a configuration such that the displacement between ejection directions of liquid ejected from the respective liquid ejection units is minimized in the first direction by arranging said energy generating means within each liquid ejection unit such that a separation between adjacent energy generating means is not perpendicular to the first direction.

2. A liquid ejection apparatus comprising a plurality of chips arranged in a first direction, each chip comprising a plurality of liquid ejection units disposed in the first direction, and each liquid ejection unit comprising at least two energy generating unit, wherein each of the plurality of chips has a configuration such that the displacement between ejection directions of liquid ejected from the respective liquid ejection units is minimized in the first direction while being maximized in a direction perpendicular to the first direction by arranging said energy generating means within each liquid ejection unit such that a separation between adjacent energy generating means is not perpendicular to the first direction.

3. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein a plurality of the energy generating means are provided in each of the liquid chamber, and wherein the plurality of the energy generating means provided in each of the liquid chamber are disposed in a direction being different from the first direction.

4. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein a region of the liquid chamber has a longer longitudinal direction and a shorter transverse direction, and the longitudinal direction is in the first direction.

5. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein the energy generating means is thermal energy generating means, and wherein a region, on which the thermal energy generating means is formed, has a longer longitudinal direction and a shorter transverse direction, and the longitudinal direction is in the first direction.

6. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein a plurality of the energy generating means are arranged in the liquid chamber, wherein the plurality of the energy generating means arranged in the one liquid chamber are disposed within the liquid chamber in a direction being different from the first direction and including a direction perpendicular to the first direction, and wherein a region of the liquid chamber has a longer longitudinal direction and a shorter transverse direction, and the longitudinal direction is in the first direction.

7. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein a plurality of the energy generating means are arranged in the liquid chamber, wherein the plurality of the energy generating means arranged in the liquid chamber are disposed within the liquid chamber in a direction being different from the first direction and including a direction perpendicular to the first direction, wherein the energy generating means is thermal energy generating means, and wherein a region, on which the thermal energy generating means is formed, has a longer longitudinal direction and a shorter transverse direction, and the longitudinal direction is in the first direction.

8. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein a region of the liquid chamber has a longer longitudinal direction and a shorter transverse direction, and the longitudinal direction is in the first direction, wherein the energy generating means is thermal energy generating means, and wherein a region, on which the thermal energy generating means is formed, has a longer longitudinal direction and a shorter transverse direction, and the longitudinal direction is in the first direction.

9. A liquid ejection apparatus comprising a plurality of chips arranged in a first direction, each chip comprising a plurality of liquid ejection units disposed in the first direction, wherein the liquid ejection unit comprises:

energy generating means for generating energy for ejecting liquid;

a liquid chamber for pressurizing liquid by the energy generated by the energy generating means; and a nozzle for ejecting the liquid pressurized in the liquid chamber, wherein a plurality of the energy generating means are arranged in the liquid chamber, wherein the plurality of the energy generating means arranged in the liquid chamber are disposed within the liquid chamber in a direction being different from the first direction and including a direction perpendicular to the first direction, wherein a region of the liquid chamber has a longer longitudinal direction and a shorter transverse direction, and the longitudinal direction is in the first direction, wherein the energy generating means is thermal energy generating means, and wherein a region, on which the thermal energy generating means is formed, has a longer longitudinal direction and a shorter transverse direction, and the longitudinal direction is in the first direction.

10. A liquid ejection apparatus comprising a plurality of chips arranged in first direction, each chip comprising a plurality of liquid ejection units disposed in the first direction, wherein each of the plurality of chips has a configuration that the displacement between ejection directions of liquid from the respective liquid ejection units is minimized in the first direction, and wherein the liquid ejection apparatus comprises ejection timing control means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction.

11. A liquid ejection apparatus comprising a plurality of chips arranged in a first direction, each chip comprising a plurality of liquid ejection units disposed in the first direction, wherein each of the plurality of chips has a configuration that the displacement between ejection directions of liquid from the respective liquid ejection units is minimized in the first direction while being maximized in a direction perpendicular to the first direction, and wherein the liquid ejection apparatus comprises ejection timing control means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction.

12. An apparatus according to claim 10 or 11, wherein the ejection timing controlling means comprises:

test-pattern data storing means for storing test pattern data for performing liquid ejection from at least one of the liquid ejection units of a chip selected from the plurality of chips; and test executing means for reading the test pattern data stored in the test-pattern data storing means so as to execute liquid ejection according to the test pattern data.

13. An apparatus according to claim 10 or 11, wherein the ejection timing controlling means comprises:

test-pattern data storing means for storing test pattern data for performing liquid ejection from at least one of the liquid ejection units of a chip selected from the plurality of chips; and test executing means for reading the test pattern data stored in the test-pattern data storing means so as to execute liquid ejection according to the test pattern data while repeating the liquid ejection according to the same test pattern data as that stored in the test-pattern data storing means a plurality of times.

14. An apparatus according to claim 10 or 11, wherein the ejection timing controlling means comprises:

test-pattern data storing means for storing test pattern data for performing liquid ejection from at least one of the liquid ejection units of a chip selected from the plurality of chips;

test executing means for reading the test pattern data stored in the test-pattern data storing means so as to execute liquid ejection according to the test pattern data; and correction data storing means for storing correction data for controlling ejection timing of liquid from the liquid ejection units of each chip, the correction data being determined based on the result of the liquid ejection executed by the test executing means, wherein the ejection timing of liquid from the liquid ejection units of each chip is controlled at least in part based upon the correction data stored in the correction data storing means.

15. An apparatus according to claim 10 or 11, wherein the ejection timing controlling means comprises:

test-pattern data storing means for storing test pattern data for performing liquid ejection from at least one of the liquid ejection units of a chip selected from the plurality of chips;

test executing means for reading the test pattern data stored in the test-pattern data storing means so as to execute liquid ejection according to the test pattern data while repeating the liquid ejection according to the same test pattern data a plurality of times; and correction data storing means for storing correction data for controlling ejection timing of liquid from the liquid ejection units of each chip, the correction data being determined based on the result of the liquid ejection executed by the test executing means, wherein the ejection timing of liquid from the liquid ejection units of each chip is controlled at least in part based upon the correction data stored in the correction data storing means.

16. An apparatus according to any one of claims 3 to 9, further comprising ejection timing control means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction.

17. An apparatus according to any one of claims 3 to 9, further comprising ejection timing controlling means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction, wherein the ejection timing control means comprises:

test-pattern data storing means for storing test pattern data for performing liquid ejection from at least one of the liquid ejection units of a chip selected from the plurality of chips; and test executing means for reading the test pattern data stored in the test-pattern data storing means so as to execute liquid ejection according to the test pattern data.

18. An apparatus according to any one of claims 3 to 9, further comprising ejection timing control means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction, wherein the ejection timing controlling means comprises:

test-pattern data storing means for storing test pattern data for performing liquid ejection from at least one of the liquid ejection units of a chip selected from the plurality of chips; and test executing means for reading the test pattern data stored in the test-pattern data storing means so as to execute liquid ejection according to the test pattern data while repeating the liquid ejection according to the same test pattern data stored in the test-pattern data storing means a plurality of times.

19. An apparatus according to any one of claims 3 to 9, further comprising ejection timing control means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction, wherein the ejection timing controlling means comprises:

test-pattern data storing means for storing test pattern data for performing liquid ejection from at least one of the liquid ejection units of a chip selected from the plurality of chips;

test executing means for reading the test pattern data stored in the test-pattern data storing means so as to execute liquid ejection according to the test pattern data; and correction data storing means for storing correction data for controlling ejection timing of liquid from the liquid ejection units of each chip, the correction data being determined based on the result of the liquid ejection executed by the test executing means, wherein the ejection timing of liquid from the liquid ejection units of each chip is controlled at least in part based upon the correction data stored in the correction data storing means.

20. An apparatus according to any one of claims 3 to 9, further comprising ejection timing control means capable of establishing ejection timing of liquid from the liquid ejection units of each chip in order to correct the displacement of the liquid landing position between the chips in a moving direction of a target object when liquid is ejected in a direction being different from the first direction and including a direction perpendicular to the first direction, wherein the ejection timing controlling means comprises:

test-pattern data storing means for storing test pattern data for performing liquid ejection from at least one of the liquid ejection units of a chip selected from the plurality of chips;

test executing means for reading the test pattern data stored in the test-pattern data storing means so as to execute liquid ejection according to the test pattern data while repeating the liquid ejection according to the same test pattern data as that stored in the test-pattern data storing means a plurality of times; and correction data storing means for storing correction data for controlling ejection timing of liquid from the liquid ejection units of each chip, the correction data being determined based on the result of the liquid ejection executed by the test executing means, wherein the ejection timing of liquid from the liquid ejection units of each chip is controlled at least in part based upon the correction data stored in the correction data storing means.

* * * * *